US009263227B2

(12) United States Patent
Matsumoto et al.

(10) Patent No.: US 9,263,227 B2
(45) Date of Patent: Feb. 16, 2016

(54) X-RAY TUBE

(71) Applicants: Futaba Corporation, Mobara-shi, Chiba (JP); Hamamatsu Photonics Kabushiki Kaisha, Hamamatsu-shi, Shizuoka (JP)

(72) Inventors: Akira Matsumoto, Mobara (JP); Kiyoyuki Deguchi, Mobara (JP); Yoshihisa Marushima, Mobara (JP); Yuuichi Kogure, Mobara (JP); Kazuhito Nakamura, Mobara (JP); Tomoyuki Okada, Hamamatsu (JP); Toru Fujita, Hamamatsu (JP); Tatsuya Nakamura, Hamamatsu (JP)

(73) Assignee: FUTABA CORPORATION, Higashi-Ku, Hamamatsu-Shi, Shizuoka (JP)

( * ) Notice: Subject to any disclaimer, the term of this patent is extended or adjusted under 35 U.S.C. 154(b) by 74 days.

(21) Appl. No.: 14/027,176

(22) Filed: Sep. 14, 2013

(65) Prior Publication Data

US 2014/0093047 A1 Apr. 3, 2014

(30) Foreign Application Priority Data

Oct. 2, 2012 (JP) ..... 2012-220583

(51) Int. Cl.
*H01J 35/16* (2006.01)
*H01J 35/18* (2006.01)

(52) U.S. Cl.
CPC ..... *H01J 35/16* (2013.01); *H01J 35/18* (2013.01); *H01J 2235/087* (2013.01); *H01J 2235/168* (2013.01)

(58) Field of Classification Search
CPC ..... H01J 35/04; H01J 35/045; H01J 35/14; H01J 35/16; H01J 35/18; H01J 2235/087; H01J 2235/165; H01J 2235/168
USPC ..... 378/121, 137, 138, 140
See application file for complete search history.

(56) References Cited

U.S. PATENT DOCUMENTS 5,044,001 A * 8/1991 Wang ..... 378/43
5,563,923 A * 10/1996 Okada ..... H01J 35/14 378/138

(Continued)

FOREIGN PATENT DOCUMENTS

CN 1879187 A 12/2006
CN 1925099 A 3/2007

(Continued)

OTHER PUBLICATIONS

Taiwan Intellectual Property Office, Examination Report and Search Report, Application No. 102135488, Oct. 2, 2014, 7 pages.

(Continued)

*Primary Examiner* — Allen C. Ho
(74) *Attorney, Agent, or Firm* — Quarles & Brady LLP

(57) ABSTRACT

An X-ray tube includes a radiopaque substrate including a window portion, an X-ray transmission window closing the window portion, an X-ray target provided at the window portion from an inner surface side of the substrate, a highly-evacuated container portion attached to the inner surface of the substrate, a cathode, a first control electrode and a second control electrode provided inside the container portion. A shielding electrode is provided at the inner surface of the substrate so as to surround the window portion. Electrons collide with the X-ray target to generate X-rays. Electrons reflected on the X-ray target between the shielding electrodes are absorbed by the shielding electrodes, so an inner surface of the container portion is not charged. The electron emission from the cathode is not affected by the reflected electrons, so a change in target current is small, and thus X-rays of substantially constant intensity can be radiated.

2 Claims, 6 Drawing Sheets

(56) References Cited

U.S. PATENT DOCUMENTS

| | | | | |
|---|---|---|---|---|
| 5,857,008 | A * | 1/1999 | Reinhold | 378/137 |
| 6,381,305 | B1 * | 4/2002 | Okada et al. | 378/137 |
| 6,487,272 | B1 * | 11/2002 | Kutsuzawa | 378/140 |
| 6,661,876 | B2 * | 12/2003 | Turner et al. | 378/138 |
| 6,944,268 | B2 * | 9/2005 | Shimono | 378/111 |
| 7,058,161 | B2 * | 6/2006 | Inazuru | H01J 35/16 378/121 |
| 7,386,095 | B2 * | 6/2008 | Okada | H01J 35/04 378/138 |
| 7,424,095 | B2 * | 9/2008 | Mildner | H01J 35/04 378/119 |
| 7,466,799 | B2 * | 12/2008 | Miller | 378/140 |
| 7,526,069 | B2 * | 4/2009 | Matsumura et al. | 378/140 |
| 7,627,088 | B2 * | 12/2009 | Matoba et al. | 378/140 |
| 7,634,054 | B2 * | 12/2009 | Matoba et al. | 378/46 |
| 7,649,980 | B2 * | 1/2010 | Aoki et al. | 378/138 |
| 7,680,248 | B2 * | 3/2010 | Matoba | 378/140 |
| 8,358,741 | B2 * | 1/2013 | Grasruck et al. | 378/137 |
| 8,761,344 | B2 * | 6/2014 | Reynolds et al. | 378/138 |
| 8,953,747 | B2 * | 2/2015 | de Looz et al. | 378/143 |
| 9,036,788 | B2 * | 5/2015 | Ueda et al. | 378/140 |
| 9,058,958 | B2 * | 6/2015 | Aoki et al. | 378/139 |
| 2007/0058782 | A1 | 3/2007 | Okada et al. | |

FOREIGN PATENT DOCUMENTS

| | | | |
|---|---|---|---|
| CN | 1853252 | B | 12/2010 |
| CN | 101521136 | B | 5/2012 |
| EP | 2006880 | A1 | 12/2008 |
| JP | 2005116534 | A | 4/2005 |
| JP | 5721681 | B2 * | 5/2015 |
| TW | 200518154 | A | 6/2005 |
| TW | 200746215 | A | 12/2007 |

OTHER PUBLICATIONS

State Intellectual Property Office of the P.R.C., First Office Action, Application No. 201310455915.7, Jul. 3, 2015, 7 pages.

* cited by examiner

X-RAY TUBE

CROSS-REFERENCE TO RELATED APPLICATION

This application claims priority from Japanese Patent Application No. 2012-220583 filed on Oct. 2, 2012, the contents of which are hereby incorporated by reference.

TECHNICAL FIELD

The present invention relates to an X-ray tube arranged to emit electrons from an electron source located on an inside of a package in a high-vacuum state, make the electrons collide with an X-ray target and radiate X-rays emitted from the X-ray target to outside through an X-ray transmission window. More specifically, the present invention relates to the X-ray tube which can prevent destabilization of operating characteristics caused by scattering, in the package, of the electrons which were reflected at the X-ray target.

BACKGROUND ART

Patent Literature 1 mentioned below discloses an X-ray generator for generating ion gas by irradiating air with X-rays. An X-ray tube used in this X-ray generator includes a main body which is a cylindrical package (or bulb). On the inside of the package, electrons emitted from a filament are focused by a focus and are collided with an X-ray target, thereby generating X-rays. The X-rays then pass through an output window (i.e. an X-ray transmission window) and exit from the package to the outside.

FIG. 4 shows a cross-sectional view of an X-ray tube which is similar to the X-ray tube of Patent Literature 1 mentioned above and which is a so-called circular-tube-type X-ray tube (hereinafter called "circular X-ray tube") having a main body which is a cylindrical package 100 made of glass. The cylindrical package 100 has a circular opening portion at its one end face. This opening portion is closed by an X-ray transmission window 101 made of a beryllium film so that the inside of the cylindrical package 100 is maintained in a high-vacuum state. On the inside of the cylindrical package 100, an X-ray target 102 is provided on an inner surface of the X-ray transmission window 101. Also, a cathode 103 as an electron source and a control electrode 104 are provided on the side of the other end face of the cylindrical package 100. The electrons emitted from the cathode 103 are accelerated by the control electrode 104, focused and collided with the X-ray target 102, thereby radiating the X-rays from the X-ray transmission window 101 to the outside of the cylindrical package 100. In FIG. 4, the X-rays radiated through the X-ray transmission window 101 to the outside of the cylindrical package 100 are indicated by a reference sign X, and a center of the emission of the X-rays at the X-ray transmission window 101 is indicated by a reference sign P.

CITATION LIST

Patent Literature 1: Japan Patent Application Publication No. 2005-116534

SUMMARY OF THE INVENTION

However, the conventional X-ray tube shown in FIG. 4 has a problem as described below. That is, in the conventional X-ray tube, the electron beam from the cathode 103 is narrowed down into a beam, providing a dot-like X-ray radiation in which the X-rays spread radially with a center P at which the electron beam had collided with the X-ray target 102 (in FIG. 4, the center is indicated with the reference sign P), and thus the X-rays spread conically after exiting through the X-ray transmission window 101 (as shown in FIG. 4 with the reference sign X). Thus, the effective irradiation area is narrow with respect to the size of an irradiated subject. Therefore, when using such circular X-ray tube having the narrow irradiation area, it is necessary to use many X-ray tubes arranged next to each other to irradiate a wide region with the X-rays, causing an increase in the facility cost and causing a maintenance problem.

For example, to irradiate a wide region, the X-rays may be radiated from a location distant from the subject. In this case, however, it is necessary to increase the irradiation intensity to irradiate the irradiation subject with desired X-rays, and also, other undesired area may be irradiated, causing a leak of X-rays.

The inventors of the present invention has invented a flat-tube-type X-ray tube (hereinafter called "flat X-ray tube") shown in FIG. 5 and FIG. 6. This X-ray tube has a main body which is a box-like package 55 including a container portion 51 and a substrate 53. The container portion 51 is formed into a box-like shape with one back plate 61 made of glass and four side plates 62 attached together. The substrate 53 is made of a radiopaque metal and is arranged at an open end of the container portion 51. The substrate 53 located on the side of the X-ray radiation of the box-like package 55 includes an elongated slit-like opening portion 52 (with a thickness of about 2 mm, for example), and an X-ray transmission window 54 made of a titanium foil is attached to the elongated slit-like opening portion 52 from the outside of the substrate 53.

Inside of the box-like package 55 is maintained in a high-vacuum state. On the inside of the box-like package 55, an X-ray target 56 such as tungsten is provided to the X-ray transmission window 54 seen through the elongated slit-like opening portion 52 of the substrate 53. Furthermore, on the inside of the box-like package 55, a back electrode 57 is provided on an inner surface of a back plate 61, i.e. an inner surface located on the opposite side of the X-ray transmission window 54. Furthermore, a filament-like cathode 58, a first control electrode 59 for drawing electrons from the filament-like cathode 58 and a second control electrode 60 for accelerating the electrons drawn by the first control electrode 59 are arranged sequentially below the back electrode 57.

According to this X-ray tube, the electrons drawn from the filament-like cathode 58 by the first control electrode 59 are accelerated by the second control electrode 60, and then the electrons collide with the X-ray target 56 to generate the X-rays. The X-rays generated from the X-ray target 56 by the collision of the electrons then pass through the X-ray transmission window 54 and radiated to the outside of the box-like package 55.

The X-rays are radiated through the X-ray transmission window 54 which is limited by the elongated slit-like opening portion 52 of the substrate 53. Thus, by setting the size of the elongated slit of the opening portion 52 to a desired size, the radiation region of the X-ray can be substantially linear so that the X-rays can spread with a slit width of the X-ray transmission window 54. Thus, the irradiation area which is effectively large with respective to the size of the subject can be set easily with a relatively high degree of freedom, thereby providing advantageous effect which cannot be obtained from the circular X-ray tube having the narrow irradiation area. Furthermore, by setting the size and shape of the elongated slit-like opening portion 52 to a rectangular slot-like shape having a desired size, it is possible to determine the radiation region of the X-rays on the X-ray transmission window 54 from the appearance more easily than the circular X-ray transmission window 101, thus it is relatively easy to set a path for accurately directing the X-rays to a desired location.

During the development of the flat X-ray tube shown in FIG. 5 and FIG. 6, the inventors of the present invention have discovered a phenomenon of change in intensity of the X-rays radiated from the flat X-ray tube. In this phenomenon, when the flat X-ray tube is operated and the X-rays are radiated, the intensity of the radiated X-rays decreases with increase in the operating time but after a certain time it begins to increase again. The inventors of the present invention have studied this phenomenon, and found out further details about this unknown phenomenon and what is behind it, as explained below.

FIG. 7 shows a cross-sectional view of a flat X-ray tube proposed by the inventors of the present invention. This flat X-ray tube has a basic structure similar to that of the flat X-ray tube shown in FIG. 5 and FIG. 6. In FIG. 7, elements similar to those of FIG. 5 and FIG. 6 are indicated by like references to eliminate explanation thereof. In this X-ray tube, when electrons emitted from a cathode 58 collided with an X-ray target 56, X-rays are emitted from the X-ray target 56 and are radiated outward through an X-ray transmission window 54. According to a study by the inventors of the present invention, it was found that, during this stage, there is a phenomenon in which the electrons which had collided with the X-ray target 56 are reflected backward toward the second control electrode 60 in the box-like package 55. FIG. 7 illustrates trajectories of the electrons which had collided with the X-ray target 56, reflected and reached to an inner surface of the box-like package 55. These results are obtained from the study by the inventors of the present invention and are obtained by simulating the trajectories of the electrons which had collided with the X-ray target 56 and reflected by analyzing the electric field in the box-like package 55 using a finite element method.

The inventors of the present invention have carried out further research on temporal changes in an X-ray target current relative value which correspond to the intensity of the X-rays radiated from the X-ray tube. The results are shown in FIG. 8. According to this example, when the X-ray tube is continuously operated with an initial current value of 100%, the current value continues to decrease (hereinafter called "current degradation") until the operating time reaches to about 100 hours, and the current value is decreased to about 60% of the initial current value when the operating time had reached to about 100 hours. After that, the current value begins to increase (hereinafter called "current increase") and returned to 100% after about 2,000 hours. The intensity of the X-rays radiated from the X-ray tube changes in a manner corresponding to the temporal changes in the X-ray target current.

The inventors of the present invention predicted that the temporal changes in the X-ray target current relative value corresponding to the X-ray intensity are caused by the behavior of the reflected electrons such as those shown in FIG. 7. As a result of further research, the inventors of the present invention had obtained the following understanding. FIG. 9 illustrates the cause of the above-mentioned current degradation which occurs during the operation of the X-ray tube. In the drawing, the electron is indicated by a reference sign "e−", and the movement of the electron is indicated by an arrow. The electron which had collided with the X-ray target 56 and reflected is collided again with the inner surface of the box-like package 55 and is reflected and moved to an inner surface, i.e. a back plate 61 having a back electrode 57, of the box-like package 55 located on the opposite side of the substrate 53 having the X-ray transmission window 54 (i.e., the back plate 61 is charged). In FIG. 9, the charged state of the back plate 61 is indicated by a reference sign "−" to distinguish from the above-mentioned reference sign "e−". Furthermore, the electron which had collided with the X-ray target 56 and reflected is collided with the inner surface of the box-like package 55, causing a secondary electron to be emitted from a glass plate of the box-like package 55. This secondary electron is moved to the back plate 61 and charges the back plate 61. In this manner, the number of the reflected electrons and the secondary electrons moved to the back plate 61 are increased, gradually causing the electrons to be less easily emitted from the cathode 58. As a result, the current degradation occurs, i.e. the X-ray target current decreases with the operating time.

FIG. 10 is an illustration for explaining the cause of the above-described current increase which occurs during the operation of the X-ray tube. In the drawing, the electron is indicated by a reference sign "e−", the sodium ion is indicated by a reference sign "Na+", and the movement of the electron and the sodium ion is indicated by an arrow. As described above, the number of the reflected electrons and the secondary electrons moved to the back plate 61 increases gradually but will saturate with time. Then, an effect of Na+(sodium ions), which were generated from contamination when the secondary electrons were generated due to the collision of the reflected electrons with the inner surface of the box-like package 55, begins to appear gradually. That is, it is considered that, as these Na+ are attached to the second control electrode 60, the first control electrode 59 and the back electrode 57, the substantive potential of these electrodes will increase, and thus a force for drawing the electrons from the cathode 58 is increased gradually, causing the increase in the X-ray target current, i.e. the current increase described above, with the operating time.

The present invention is based on the above-described new problem which was found by analyzing the phenomenon discovered by the inventors of the present invention. Thus, an object of the present invention is to provide a flat X-ray tube which includes an electron source, a control electrode and an X-ray target and such arranged inside of a package in a high-vacuum state and which prevents a change in X-ray intensity with time.

In order to achieve the above-described object, the present invention provides, in a first aspect, an X-ray tube including: a radiopaque substrate including a slit-like window portion; an X-ray transmission window provided from a side of an outer surface of the substrate so as to close the window portion; an X-ray target provided at the window portion from a side of an inner surface of the substrate; a container portion attached to the inner surface of the substrate, an inside of the container portion being in a high vacuum state; an electron source provided to the inside of the container portion and arranged to supply electrons to the X-ray target; a first control electrode positioned between the electron source and the X-ray target inside the container portion, the first control electrode being arranged to draw electrons from the electron source; and a second control electrode positioned inside the container portion and between the first control electrode and the X-ray target, the second control electrode defining an irradiation area of an electron beam; wherein a shielding electrode is provided at the inner surface of the substrate and arranged along a longitudinal direction of the window portion.

Furthermore, the present invention provides, in a second aspect, the X-ray tube described above, wherein the shielding electrode is provided in a pair so as to sandwich the window portion, such that electrons collided with the X-ray target and reflected are prevented from reaching to an inner surface of the container portion and that discharge between the shielding electrode and the second control electrode is prevented, and wherein a distance between each of the shielding electrodes and the second control electrode is set such that an electric field formed between the shielding electrodes and the second control electrode at an operating voltage does not exceed a discharge electric field threshold of 10 kV/mm.

As explained above, according to the X-ray tube described in the first aspect, the electrons drawn from the electron source by action of the first control electrode are collided with the X-ray target within the irradiation area defined by the second control electrode. As a result, X-rays are generated from the X-ray target are radiated to outside through the X-ray transmission window. At the same time, some of the electrons collided with the X-ray target are reflected, and some of these reflected electrons travel toward the inner surface of the container portion and such if no measure is taken. However, since the X-ray tube is provided with the shielding electrode arranged on the inner surface of the substrate along the slit-like window portion having the X-ray target with which the electrons collide, the electrons reflected on the X-ray target between the shielding electrodes are absorbed by the shielding electrodes and become a part of the X-ray target current, so the electrons will not reach to the inner surface of the container portion and such. As a result, even if the X-ray tube is continuously operated, the emission of electrons from the electron source will not be unstable with time, preventing the above-mentioned current degradation and the current increase. In other words, regardless of time, the target current can be stabilized, and the X-rays of constant and uniform intensity can be radiated at all times.

As explained above, according to the X-ray tube described in the second aspect, the shielding electrode is provided in a pair so as to sandwich the slit-like window portion, and the distance between the pair of shielding electrodes, the height of the respective shielding electrodes and the distance between the shielding electrode and the second control electrode is set to be within a suitable value determined by experiments. Thus, the discharge does not occur between the shielding electrode and the second control electrode, and the electrons which had collided with the X-ray target sandwiched between the shielding electrodes and reflected will not reach to the inner surface of the container but will reach to the shielding electrode and absorbed.

DESCRIPTION OF EXEMPLARY EMBODIMENTS

Figure 1:
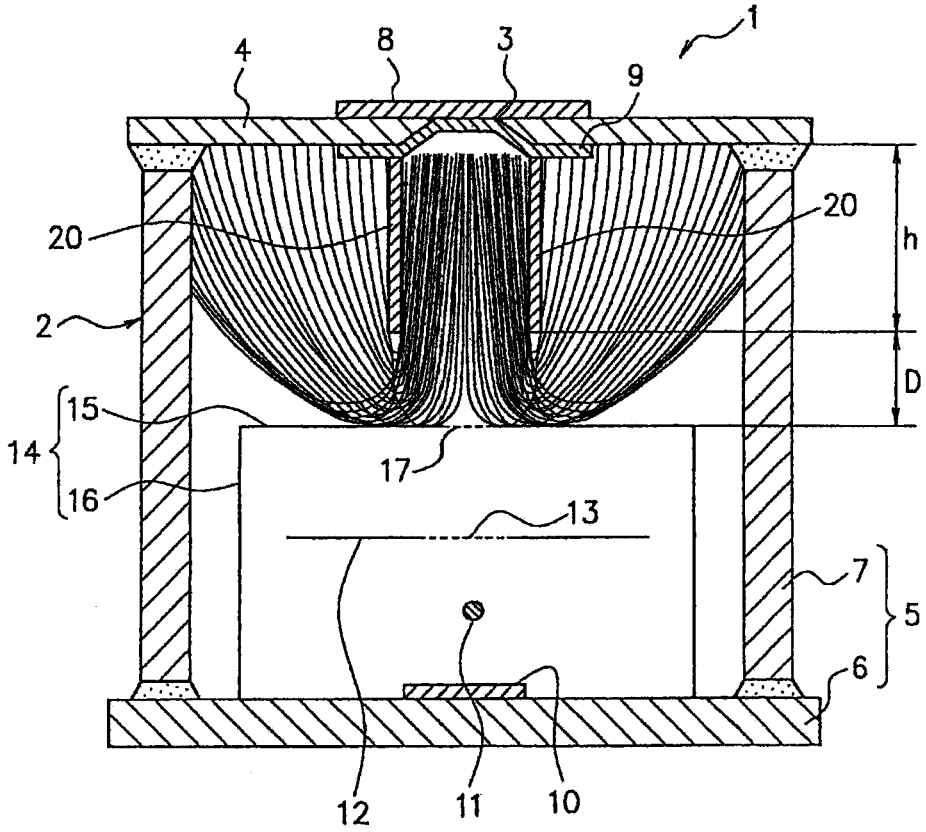
FIG. 1 is a cross-sectional view showing an X-ray tube according to a first embodiment of the present invention and illustrating trajectories of reflected electrons in the X-ray tube.
Figure 2:
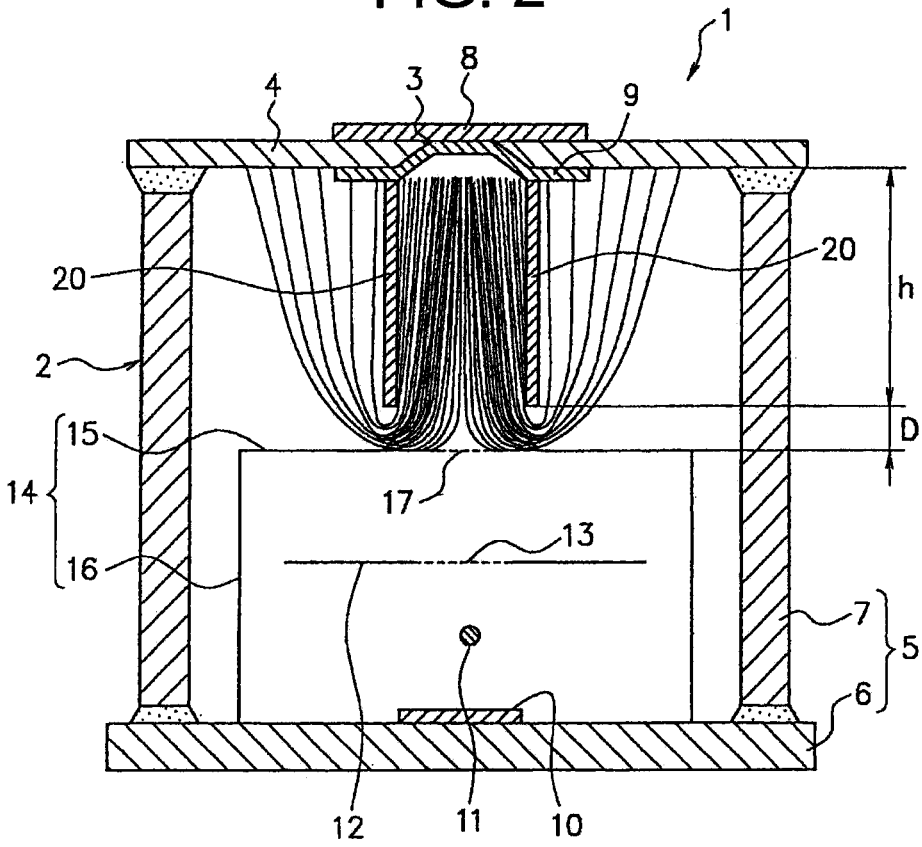
FIG. 2 is a cross-sectional view showing a modified version of the X-ray tube of the first embodiment and illustrating trajectories of reflected electrons in the X-ray tube.
Figure 3:
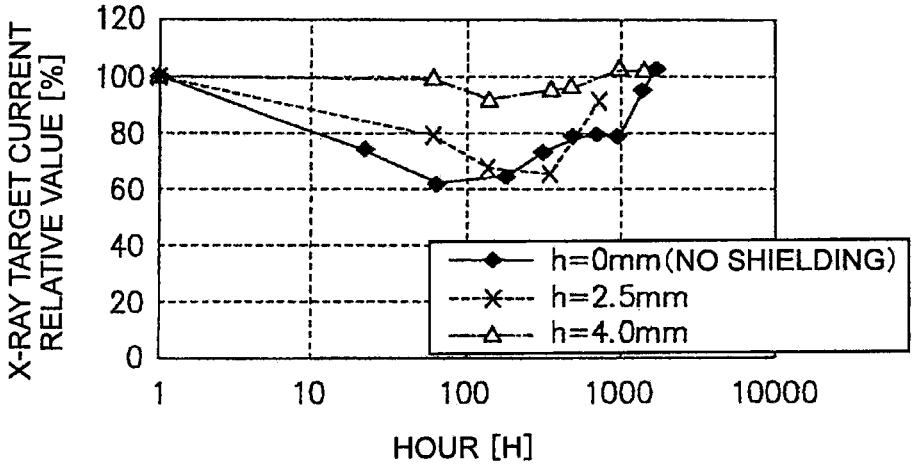
FIG. 3 is a graph showing a relationship between operating time and an X-ray target current for the X-ray tube of the first embodiment, the X-ray tube of the modified version of the first embodiment and a conventional X-ray tube developed by the inventors of the present invention.
Figure 4:
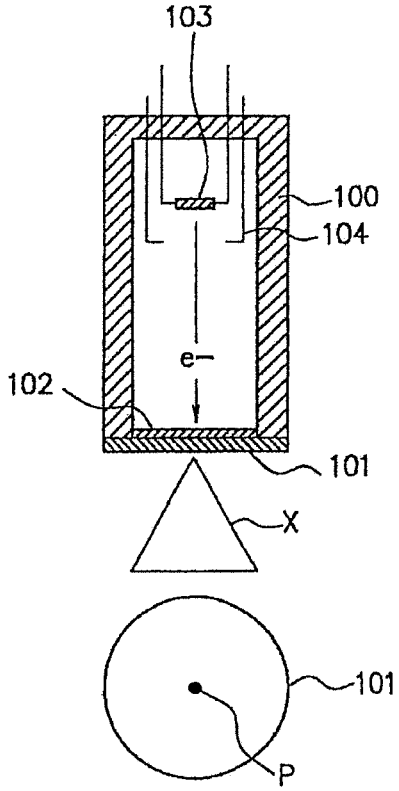
FIG. 4 PRIOR ART
FIG. 4 is a cross-sectional view of a convention circular X-ray tube and an X-ray radiation region thereof is illustrated schematically.
Figure 5:
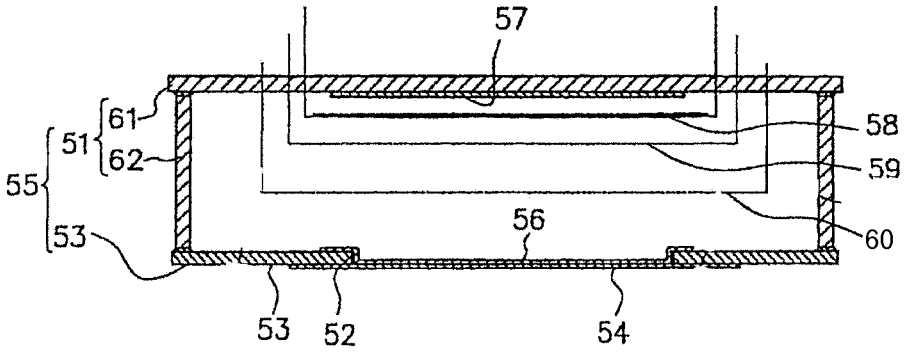
FIG. 5 PRIOR ART
FIG. 5 is a cross-sectional view of an old model X-ray tube developed by the inventors of the present invention.
Figure 6:
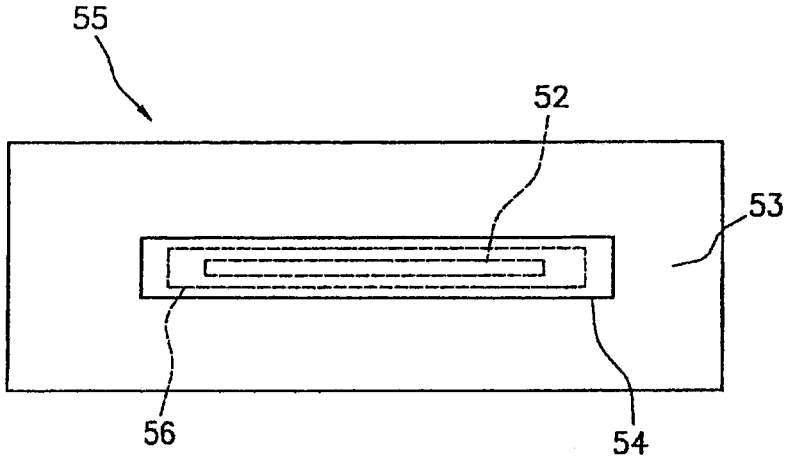
FIG. 6 PRIOR ART
FIG. 6 is a front view of the old model X-ray tube developed by the inventors of the present invention.
Figure 7:
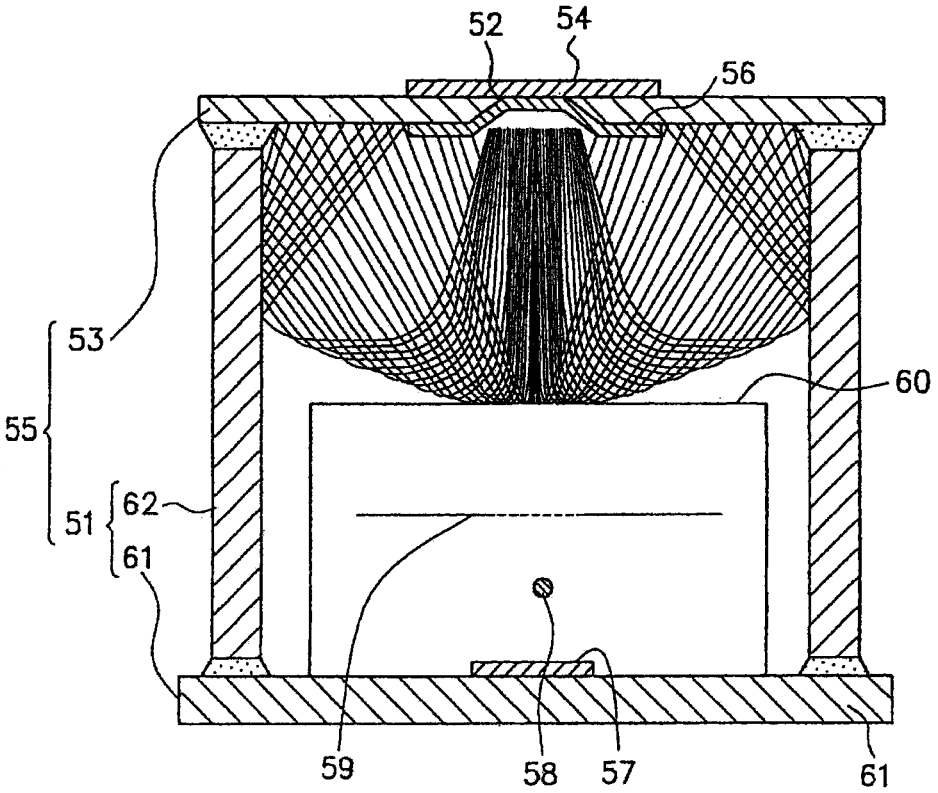
FIG. 7 PRIOR ART
FIG. 7 is a cross-sectional view showing trajectories of reflected electrons in an old model X-ray tube developed by the inventors of the present invention.

In the following, a first embodiment of the present invention is explained in reference to FIGS. 1 to 3. An X-ray tube shown in FIG. 1 and an X-ray tube shown in FIG. 2 have the same structure except for a later-described shielding electrode. The shielding electrode of FIG. 1 and the shielding electrode of FIG. 2 are different in size. FIG. 1 and FIG. 2 show trajectories of reflected electrons obtained from a simulation by an analysis of electric field using a finite element method. FIG. 3 is a graph showing a relationship between operating time and an X-ray target relative current for X-ray tubes of the above-described two examples of the first embodiment and for an old model conventional X-ray tube developed by the inventors of the present invention.

An X-ray tube 1 according to the first embodiment shown in FIG. 1 and FIG. 2 is a flat-tube-type and includes a box-like package 2 as a main body. This box-like package 2 includes a radiopaque substrate 4 provided with a window portion 3, and a box-like container portion 5 attached to a side of an inner surface of the radiopaque substrate 4. Inside of the box-like package 2 is highly evacuated to maintain a high vacuum state. The radiopaque substrate 4 is a rectangular plate made of a radiopaque alloy 426, and the box-like container portion 5 is formed by assembling a back plate 6 and a side plate 7 made of a soda-lime glass. The radiopaque Alloy 426 is alloy of 42% Ni, 6% Cr and remnant Fe, for example, and has substantially the same coefficient of thermal expansion with the soda-lime glass.

As shown in FIG. 1 and FIG. 2, the window portion 3 which is a slit-like opening portion is formed at a center of the radiopaque substrate 4 to radiate the X-rays to outside. Herein, the term "slit-like" means a shape in general having two directions, namely a longitudinal direction and a lateral (i.e. short-side) direction, and specifically, it means an elongated shape such as a rectangular shape or an oval shape. In this embodiment, the slit-like shape is an elongated rectangular shape. An X-ray transmission window 8 made of a titanium foil which is larger than the window portion 3 is adhered to the window portion 3 so as to close the window portion 3. On the inside of the box-like package 2, a tungsten film is deposited on an inner surface of the radiopaque substrate 4 around the window portion 3 and on an inner surface of the X-ray transmission window 8 (i.e. the titanium foil) seen from the window portion 3, thereby forming an X-ray target 9. The X-ray target 9 is metal which emits X-rays upon collision of an electron with the X-ray target 9. The X-ray target 9 may be made of metal other than tungsten, such as molybdenum.

In the following, configuration of an electrode in the box-like package 2 is explained. As shown in FIG. 1 and FIG. 2, on the inside of the box-like package 2, a back electrode 10 is provided on an inner surface of the box-like container portion 5 on the opposite side of the X-ray transmission window 8 (i.e. an inner surface of the back plate 6 which is parallel to the radiopaque substrate 4). A linear cathode 11 as an electron source is positioned right above the back electrode 10. The linear cathode 11 is formed by covering a surface of a core wire made of tungsten or the like with carbonate, and can emit thermal electrons when the core wire is heated by applying current.

A first control electrode 12 for drawing electrons from the linear cathode 11 is provided above the linear cathode 11. The first control electrode 12 includes a slit-like opening portion 13, and a mesh is provided in the slit-like opening portion 13.

A second control electrode 14 defining the irradiation area of an electron beam is provided above the first control electrode 12. The second control electrode 14 is a box-like electrode member including a rectangular center plate 15 and a plate-body 16 surrounding the rectangular center plate 15. The second control electrode 14 is provided on the inner surface of the back plate 6 so as to surround the back electrode 10, the linear cathode 11 and the first control electrode 12. The rectangular center plate 15 of the second control electrode 14 includes a slit-like opening portion 17 formed at a location corresponding to the linear cathode 11. The width of this slit-like opening portion 17 is smaller than the width of the slit-like opening portion 13 of the first control electrode 12, and the opening portion 17 includes a mesh as with the slit-like opening portion 13 of the first control electrode 12.

The radiopaque substrate 4 includes a shielding electrode 20 extending from the inner surface of the radiopaque substrate 4 and arranged in parallel with the longitudinal direction of the window portion 3 of the radiopaque substrate 4. The shielding electrode 20 may be provided as a pair of plate-like electrode members and is arranged such that there is an electrical continuity between the shielding electrode 20 and the X-ray target 9. The pair of shielding electrodes 20, 20 is formed into a rectangular shape and arranged along the longitudinal direction of the slit-like opening portion 13 of the first control electrode 12 or along the longitudinal direction of the slit-like opening portion 17 of the second control electrode 14. Also, the pair of shielding electrodes 20, 20 is fixed on the side of the radiopaque substrate 4 by welding from the side of the inner surface of the radiopaque substrate 4 so as to be parallel to each other along the longitudinal edge of the window portion 3.

As explained below, the dimension in the height direction (i.e. height), h, of the pair of shielding electrodes 20, 20 perpendicular to the radiopaque substrate 4 is set based on the inventor's knowledge and the results of the simulation of electron trajectories by an analysis of electric field using a finite element method as well as the experimental results. That is, the height, h, of the pair of shielding electrodes 20, 20 is set such that the electric discharge does not occur between the second control electrode 14 and the pair of shielding electrodes 20, 20, and that trajectories of the electrons collided with the X-ray target 9 and reflected between the pair of shielding electrodes 20, 20 are blocked to prevent the reflected electrons from reaching to the side plate 7 of the slit-like container portion 5.

FIG. 1 shows an example of the shielding electrode 20 having the height, h, of 2.5 mm, and in this case, the distance D between the shielding electrode 20 and the second control electrode 14 is 3 mm. FIG. 2 shows another example of the shielding electrode 20 having the height, h, of 4.0 mm, and in this case, the distance D between the shielding electrode 20 and the second control electrode 14 is 1.5 mm. That is, the distance between the radiopaque substrate 4 and the second control electrode is set to be 5.5 mm. As with the example shown in FIG. 1, at least, when the height, h, is equal to or greater than 2.5 mm, the number of electrons reaching to the side plate 7 of the radiopaque container portion 5 is decreased, and the decrease in change in the X-ray target current begin to appear. Although not shown, when the height is h=3.5 mm, the number of electrons reaching to the side plate 7 of the radiopaque container 5 is further decreased. Moreover, as with the example shown in FIG. 2, when the height, h, is equal to or greater than 4.0 mm, then almost no reflected electrons will reach to the side plate 7, and thus the current degradation and the current increase described above are no longer observed.

Furthermore, according to the inventor's knowledge, in order to prevent the discharge between the shielding electrode 20 and the second control electrode 14, the actual distance between the shielding electrode 20 and the second control electrode 14 is preferably at least 1 mm as with the examples shown in FIG. 1 and FIG. 2, when the potential difference between the X-ray target 9 and the second control electrode 14 of the X-ray tube 1 is about a few kV. For a general evacuated tube, a threshold electric field of the discharge between the electrodes is considered to be 10 kV/mm. Thus, in the present embodiment, for the sake of safety, the distance between the shielding electrode 20 and the second control electrode 14 is set to be 1 mm or more, which is the condition which can prevent the discharge even if the operating voltage is twice the operating voltage 5 kV used in this embodiment.

Figure 8:
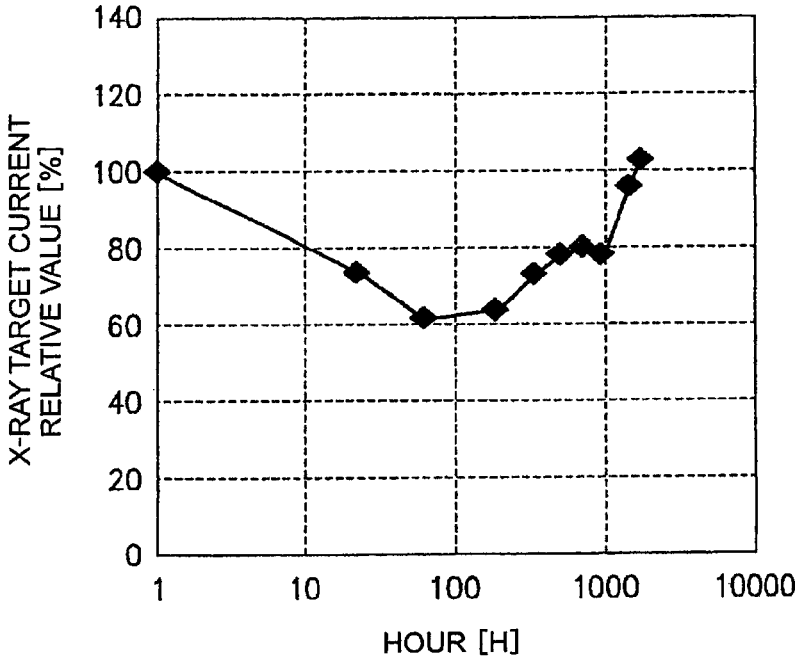
FIG. 8 PRIOR ART
FIG. 8 is a graph showing a relationship between operating time and an X-ray target current for the old model X-ray tube developed by the inventors of the present invention.
Figure 9:
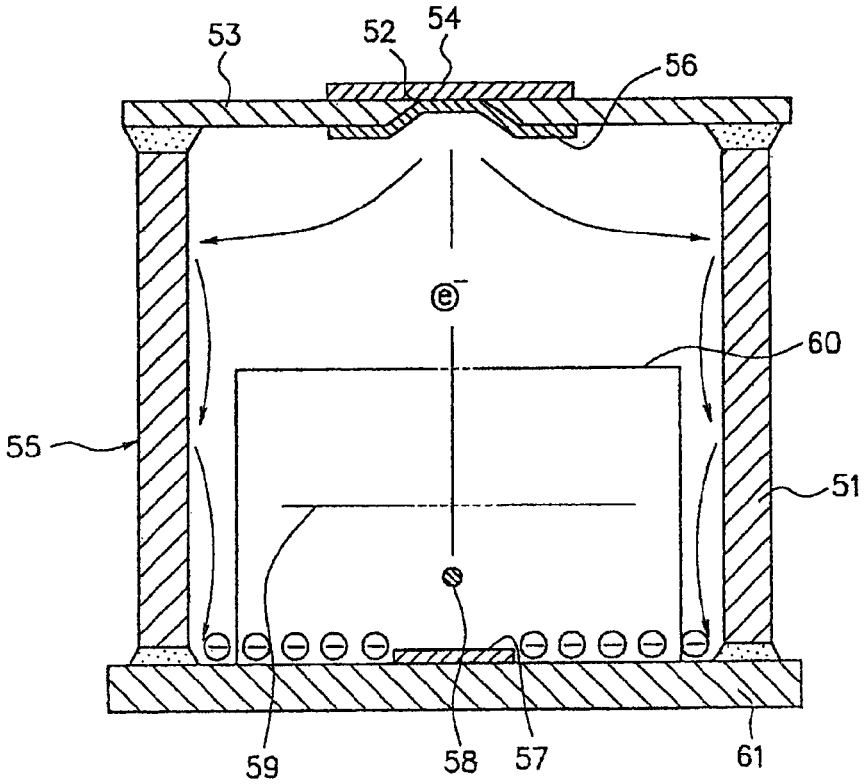
FIG. 9 PRIOR ART
FIG. 9 is a cross-sectional view for explaining a cause of a current degradation in the old model X-ray tube developed by the inventors of the present invention.
Figure 10:
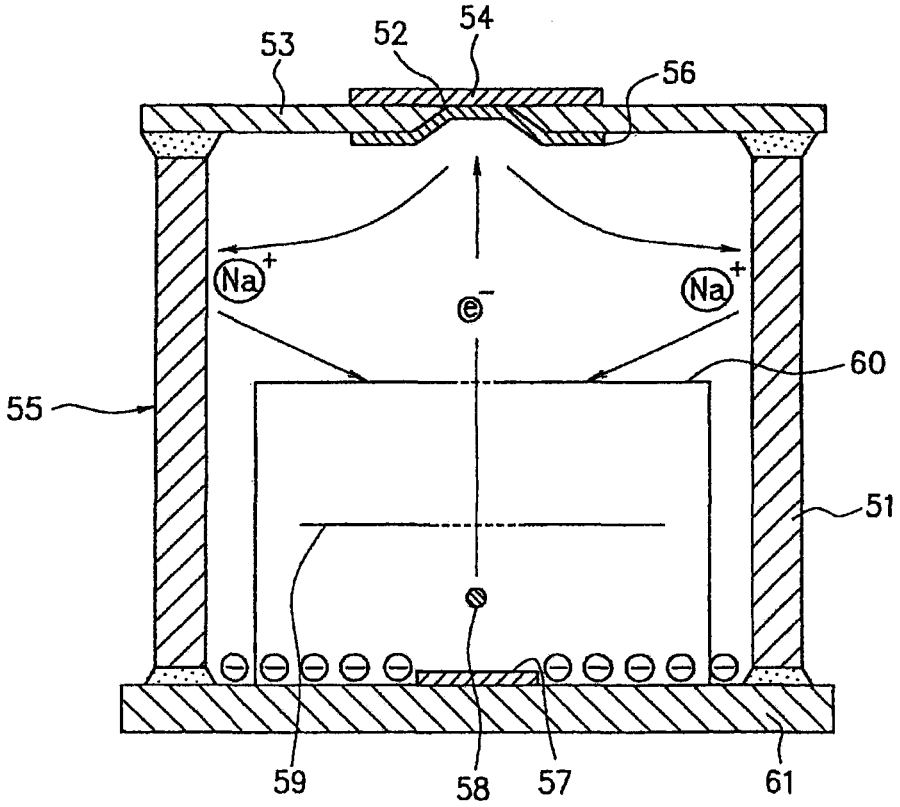
FIG. 10 PRIOR ART
FIG. 10 is a cross-sectional view for explaining a cause of a current increase in the old model X-ray tube developed by the inventors of the present invention.

FIG. 3 is a graph showing a relationship between the operating time and the X-ray target relative current value for the X-ray tube (h=2.5 mm) of the embodiment of FIG. 1, the X-ray tube (h=4.0 mm) of the embodiment shown in FIG. 2, and an old model conventional X-ray tube (h=0 mm) developed by the inventors of the present invention. As can be seen from this graph, according to the old model X-ray tube (h=0 mm) developed by the inventors, as already explained in reference to FIG. 8, the X-ray target current changed largely with time, in which the maximum current degradation to 60% is observed, and after that the current increase is observed, and the X-ray target current returned to 100%. In contrast, according to the X-ray tube (h=2.5 mm) of the embodiment shown in FIG. 1, the process of the current degradation is slower and the current increase occurs more rapidly compared to the old model X-ray tube. That is, in the X-ray tube of FIG. 1 the X-ray target current value of 80% is maintained after a lapse of about 60 hours, at which time the X-ray target current value of the old motel X-ray tube had reached to about 60%, i.e. its lowest value. Also, in the X-ray tube of FIG. 1, the current increase after the lowest value was observed is more rapid compared to the old model X-ray tube. Moreover, according to the X-ray tube (h=4.0 mm) of the embodiment shown in FIG. 2, no current degradation was observed until a lapse of about 60 hours, at which time the X-ray target current value of the old motel X-ray tube had reached to about 60%, and after that, although a slight current degradation was observed, the maximum current degradation was to about 90%. The current degradation of such level occurs after a lapse of 100 hours, but the current degradation state does not continue thereafter, and the current value returns rapidly to the original current value.

As described above, according to the X-ray tube 1 of the present invention, the electrons drawn from the cathode 11 due to the action of first control electrode 12 are controlled to be within a predetermined irradiation area by the second control electrode 14 and collide with the X-ray target 9 between the pair of shielding electrodes 20, 20. As a result, the X-rays are emitted from the X-ray target 9 to outside from the X-ray transmission window 8. At the same time, some of the electrons collided with the X-ray target 9 are reflected, and some of these reflected electrons travel toward the side plate 7 of the box-like container portion 5 and such, if no measure is taken. However, since the X-ray tube 1 is provided with the shielding electrodes 20 arranged on the inner surface of the radiopaque substrate 4 so as to surround the window portion 3 having the X-ray target 9 with which the electrons collide, the electrons reflected on the X-ray target 9 between the shielding electrodes 20, 20 will be absorbed by the shielding electrodes 20 and become a part of the X-ray target current. Thus, the reflected electrons will not reach to the inner surface of the box-like container portion 5 and such. Consequently, even if the X-ray tube 1 is continuously operated, the emission of electrons from the cathode 11 will not be unstable with time as described above. Thus, the above-mentioned current degradation and the current increase will not occur, and thus the target current is stabilized, and the constant X-ray can be radiated at all times.

Furthermore, according to the X-ray tube 1 of this embodiment, since the X-ray target 9 is formed of the deposited film made of an element with large atomic number such as tungsten, many electrons collided with this X-ray target 9 will become the reflected electrons. However, since the shielding electrodes 20, 20 which are provided so as to sandwich the X-ray target 9 are made of the same metal with the radiopaque substrate 4 and are integrally formed with the radiopaque substrate 4, the reflected electrons can be captured by the shielding electrodes 20 which are electrically one with the radiopaque substrate 4 and the X-ray target 9.

In a general X-ray tube, since an X-ray transmission window provided to a window portion of a substrate is made of a metal foil with low strength, there is a possibility of an accident in which the foil is broken and the vacuum state of a package is lost. Regarding this point, according to the X-ray tube 1 of the present embodiment, the shielding electrodes 20 which are made of the same metal as the radiopaque substrate 4 are fixed to the radiopaque substrate 4 by welding such that the shielding electrodes 20 are located on both sides of the X-ray transmission window 8 provided to the window portion 3 so as to be in parallel along the longitudinal direction. Thus, the strength of the X-ray transmission window 8 is improved, thereby decreasing the chance of twist or deformation of the radiopaque substrate 4 and preventing the leak accident due to the breakage of the metal foil.

Preferably, the first control electrode 12, the second control electrode 14 and the shielding electrode 20 are made of the alloy 426 as with the radiopaque substrate 4 to give substantially the same thermal expansion coefficient with the box-like container portion 5 made of a soda-lime glass. In the case where the material of the box-like container portion 5 is a glass plate other than the soda-lime glass, then the radiopaque substrate 4, the first control electrode 12, the second control electrode 14 and the shielding electrode 20 may be made of other metal plate to give substantially the same thermal expansion coefficient with the box-like container portion 5.

The embodiment described herein is only representative of the present invention, and the present invention is not limited to this. That is, the present invention can be modified and implemented in various ways without departing from the gist of the present invention.

REFERENCE SIGN LIST

1 X-ray tube
2 box-like package
3 window portion
4 radiopaque substrate
5 box-like container portion
8 X-ray transmission window
9 X-ray target
11 cathode (electron source)
12 first control electrode
14 second control electrode
20 shielding electrode

The invention claimed is:

1. An X-ray tube comprising:

a radiopaque substrate including a slit-like window portion;

an X-ray transmission window provided from a side of an outer surface of the radiopaque substrate so as to close the slit-like window portion;

an X-ray target provided at the slit-like window portion from a side of an inner surface of the radiopaque substrate;

a container portion attached to the inner surface of the radiopaque substrate, an inside of the container portion being in a high vacuum state;

an electron source provided to the inside of the container portion and arranged to supply electrons to the X-ray target;

a first control electrode positioned between the electron source and the X-ray target inside the container portion, the first control electrode being arranged to draw electrons from the electron source;

a second control electrode positioned inside the container portion and between the first control electrode and the X-ray target, the second control electrode defining an irradiation area of an electron beam; and a shielding electrode is provided at the inner surface of the radiopaque substrate and arranged along a longitudinal direction of the slit-like window portion.

2. The X-ray tube according to claim 1, wherein the shielding electrode is provided in a pair of shielding electrodes so as to sandwich the slit-like window portion, such that electrons collided with the X-ray target and reflected are prevented from reaching to an inner surface of the container portion and that discharge between the pair of shielding electrodes and the second control electrode is prevented, and wherein a distance between each of the pair of shielding electrodes and the second control electrode is set such that an electric field formed between the pair of shielding electrodes and the second control electrode at an operating voltage does not exceed a discharge electric field threshold of 10 kV/mm.

* * * * *